United States Patent [19]

Larsson

[11] 4,116,152

[45] Sep. 26, 1978

[54] REEFING APPARATUS FOR A SAILING SHIP

[76] Inventor: Karl Olof Axel Helmer Larsson, Industriestrasse 40, CH - 6300, Switzerland

[21] Appl. No.: 753,710

[22] Filed: Dec. 23, 1976

[30] Foreign Application Priority Data

Feb. 19, 1976 [SE] Sweden ..... 7601980

[51] Int. Cl.[2] ..... B63H 9/04

[52] U.S. Cl. ..... 114/106; 114/39

[58] Field of Search ..... 114/102, 104–107, 114/112, 39

[56] References Cited

U.S. PATENT DOCUMENTS

| | | | |
|---|---|---|---|
| 308,146 | 11/1884 | Fearon | 114/106 |
| 1,675,081 | 6/1928 | Andrade, Jr. | 114/106 |
| 3,132,620 | 5/1964 | Court | 114/106 |
| 3,260,230 | 7/1966 | Kauert | 114/106 |
| 3,285,215 | 11/1966 | Potter | 114/106 |

*Primary Examiner*—Trygve M. Blix

*Assistant Examiner*—D. W. Keen

*Attorney, Agent, or Firm*—Olson, Trexler, Wolters, Bushnell & Fosse, Ltd.

[57] ABSTRACT

Reefing apparatus for a sail of a sailing boat makes use of a hollow boom for the sail. The boom has a lengthwise slit in the top extending over the length of the sail footrope and contains a tubular shaft which can rotate within the boom and to which the footrope is attached. A second shaft is located within the tubular shaft and is coupled to the tubular shaft by a spring, which is stressed on rotation of the tubular shaft relative to the second shaft.

The sail is rolled up on the tubular shaft and within the boom. When the sail is raised, it is unrolled from the tubular shaft and drawn through the slit, the spring being progressively stressed. When the sail is to be reefed, the halyard is appropriately slackened, when the sail is drawn into the boom by the action of the spring and rolled on the tubular shaft, until the required reduced sail area is obtained.

6 Claims, 3 Drawing Figures

Fig. 2 (A-A)

REEFING APPARATUS FOR A SAILING SHIP

OBJECTS AND SUMMARY OF THE INVENTION

This invention relates to reefing apparatus for a sailing ship. For sail reefing, either reefing points or roller reefing gear have been used; in the former, that part of the sail that is not required is, after the sail halyard has been eased, drawn against the boom, by rope ends sewn onto the sail or by loose rope ends, and tied to the boom. Reefing points have the advantage that the hang of the sail when reefed is only slightly affected, if at all, but their use is time consuming. With roller reefing gear, the boom, rotatably mounted at its head and end, is rotated about its axis, usually with the aid of a worm gear. As the halyard is eased, the sail is therefore wound round the boom. Roller reefing gear can usually be operated by one man. The spread of the sail can be steplessly adjusted to the requirements arising, but the sail does not always hang well after being reefed. Both reefing methods, however, necessitate the use of a crew of at least two, since one is required to steer and at least one other to operate the reefing.

An aim of the invention is to provide reefing apparatus which can be operated simply and rapidly and which will detract less than the previously mentioned reefing arrangements from the sailing properties of the vessel when the sail has been reefed.

In accordance with the present invention, reefing apparatus for a sailing vessel comprises, for a sail of the vessel, a hollow boom which has a lengthwise slit therein with a length at least equal to that of the footrope of the sail; a shaft which is rotatably mounted within the boom, which extends over approximately the length of the slit, and which is adapted to have the sail footrope attached to it, and drive means for rotating the shaft in order to roll up the sail on the shaft. The shaft is preferably hollow and is rotatably mounted about a second shaft mounted in the boom and is capable of being coupled to the second shaft.

The drive means may consist of a spring which is operatively arranged between the shafts and can be stressed at least by the unrolling of the sail.

The reefing apparatus of the invention has a number of advantages. A considerable advantage resides in the fact that the driving means is protected within the boom and moves more smoothly, because it is no longer necessary to rotate the entire boom, which is usually of considerable diameter, but only the shaft within it. A further advantage resides in the fact that the reefed sail can emerge from the middle of the boom, i.e. from the slit provided therein, and can thus be centered in respect of the axis of the boom, while the reefed part of the sail is situated inside the boom, where it cannot influence the flow, so that the hang of the sail and the propulsion properties of the vessel are no longer adversely affected by the sailcloth, which was hitherto on the boom.

When the drive means comprise a spring, which is stressed by the setting of the sail and can be stressed still further by a manual drive, reefing becomes almost automatic; all that is required for reefing is for the halyard of the sail in question to be lowered, whereupon the sail is automatically rolled up to the desired extent by the action of the spring. As the halyards for the sails of modern yachts in any case are taken to the cockpit, the reefing operation carried out with the apparatus does not then even require an additional man, but can be effected by the helmsman himself.

The reefing apparatus can be applied to the mainsail and also to the foresail, if the latter has a jib boom. The use of a jib boom results in a foresail having a shorter footrope than one used without a jib boom and hence in a loss of sail area. However, that loss can be compensated, and the same sail area achieved, by enlarging the heights of the mainsail and foresail.

BRIEF DESCRIPTION OF THE DRAWINGS

The invention will be more readily understood by way of example from the following description of reefing apparatus in accordance therewith, reference being made to the accompanying drawings, in which.

DETAILED DESCRIPTION

Figure 3:
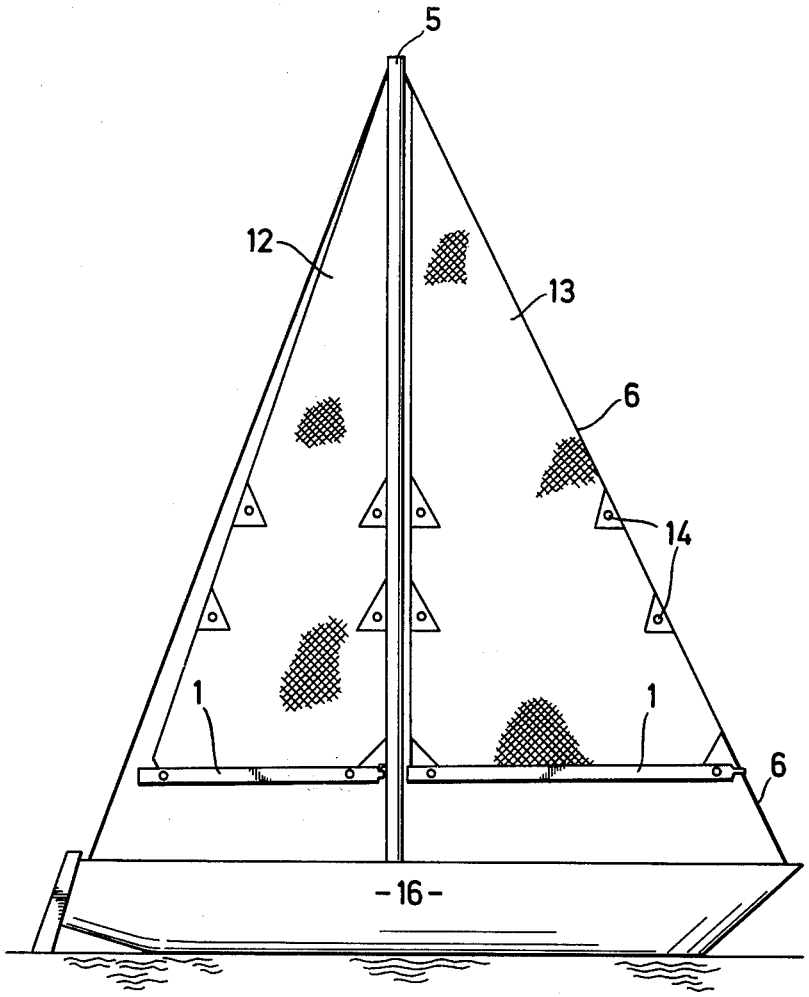
FIG. 3 is a side view of a sailing vessel with boom jib and mainsail.

The sailing vessel 16 in FIG. 3 is rigged as a sloop and thus has a mast 5, a foresail 13 and a mainsail 12. There are also two booms 1, i.e. a jib boom and a main boom. The booms may be of any desired cross section. In the example shown the cross section is circular.

Figure 2:
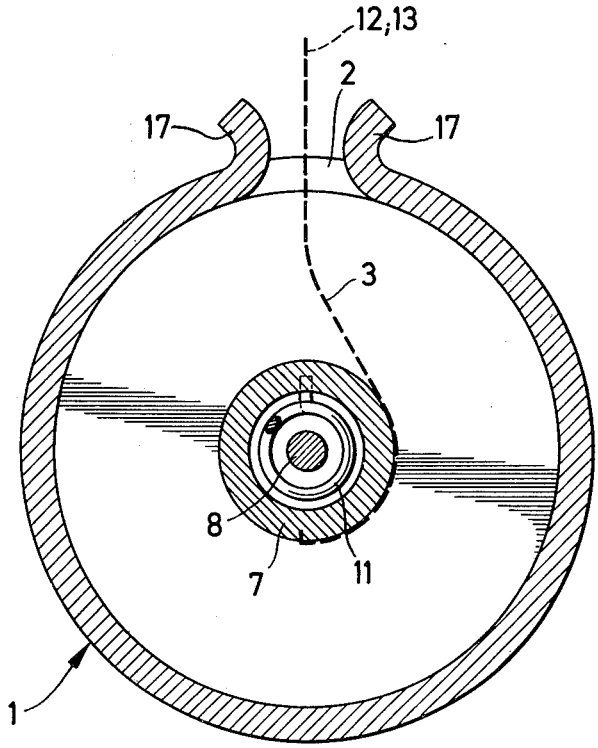
FIG. 2 is a section through the boom, on the line A—A of FIG. 1.

Each boom is hollow and has in its upper surface a central longitudinal slit 2 having inlet guides lips 17, which are shown only in FIG. 2. Inside the boom 1 is a shaft system consisting of a hollow shaft 7 and a second shaft 8 situated within shaft 7. In the example shown the shaft 8 is journalled in the end of the boom 1 and in the boom head bearing 4, the shaft at its left hand end being integral with an intermediate stub shaft 15. The hollow shaft 7 is mounted on shaft 8 so as to be easily rotatable but axially non-displaceable.

Figure 1:
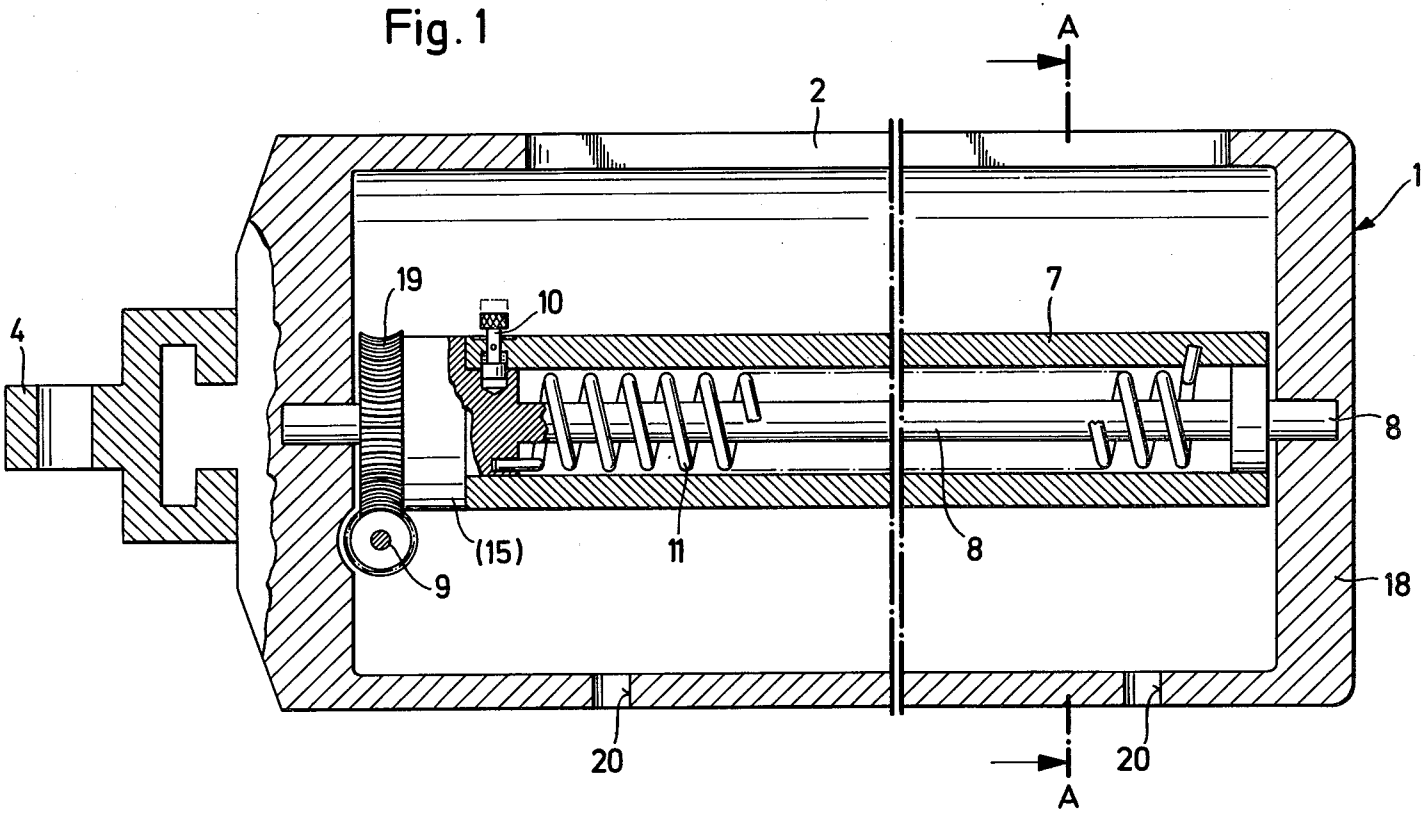
FIG. 1 is a longitudinal section through parts of a sail boom.

Instead of the arrangement shown, the tail end on the right in FIG. 1 of the hollow shaft 7 may be journalled directly in the boom 1. In that case shaft 8 is reduced from the intermediate shaft 15 which rotatably bears the adjacent end of the hollow shaft 7 as shown; in a further version of this example the intermediate shaft 15 also extends into the interior of the hollow shaft 7, in which it terminates in a bearing.

Between the shaft 8 and the hollow shaft 7, or between an extension of the intermediate shaft 15 projecting into the interior of the hollow shaft 7, on the one hand, and the hollow shaft 7 itself, on the other, is a spring 11 rigidly connected by one end to the hollow shaft 7 and by the other end to the shaft 8 (or the intermediate shaft 15). If the shaft 8 (or the intermediate shaft 15, in the example not shown) is held by means of a releasable locking device, e.g. consisting of the gearing formed by a worm shaft 9 and a worm wheel 19, and if the hollow shaft 7 is rotated, the spring 11 is stressed. In the example shown in FIG. 1 shaft 8 forms a guide for the spring 11. In the modification described above, the central guiding device for the spring 11 is either dispensed with or formed by that end of the intermediate shaft 15 which extends into the hollow shaft 7; preference is given to this latter method if the spring can be made shorter than the space provided for it inside the boom.

The footrope of the sail 12 or 13 is securely connected to the hollow shaft 7 and is taken upwards from the latter through the slit 2 and in the direction shown by the broken line 3 in FIG. 2. It will be obvious that rotation of the hollow shaft 7 causes the said (according to the direction of the said rotation) to be unrolled from or rolled up onto it. The shafts 7 and 8 can be rigidly interconnected by means of a bolt 10, shown as engageable in the intermediate shaft 15. The bolt 10, in the example shown, is resiliently biased into its coupling position. It can be withdrawn in the axial direction and secured by rotation, in a stop position in which the coupling between the shafts 7 and 8 is released. With bolt 10 in non-coupling position, it is possible to rotate the hollow shaft 7, which is then freely rotatable in relation to the shaft 8. This is done, for example, by means of the worm gear 9, 19, or by means of a crank acting on the shaft 8 in an axial direction, in the zone of the tail 18 of the boom. With the coupling in operative position, the sail affixed to the hollow shaft 7 can be manually rolled up onto the hollow shaft 7 by manually rotating shaft 8; that process is not accompanied by any change in the stressing of spring 11. If the coupling between the two shafts is subsequently released the sail can be hoisted on the mast by means of the relevant halyard. The hollow shaft 7 then rotates in its bearings, the spring 11 being stressed at the same time, since the shaft 8 is held, e.g. via the gearing 9, 19. It has been found advantageous to prestress the spring 11, after the sail has been completely hoisted, still further by additional and manual rotation of the shaft 8.

If the sail is to be taken in or reefed after these necessary preparations, all that is required is to release the relevant halyard. The spring 11 then causes the hollow shaft 7 to draw the sail through the slit 2 in the boom 1 and roll it up inside the said boom 1. It is obvious that the sails can be set to any spread by simply releasing the halyard to an appropriate extent, and that this can be done, if the halyard extends to the cockpit, without an additional man. It goes without saying that the automatic reefing or furling of the sail or sails, explained in the foregoing, depends on the mast rope of the sail in question being guided in a groove provided in the mast of forestay 6, in the manner now usual. If slides are used, the sail is secured to the slides in the usual manner, by a line, so that in this case all that is required for the reefing is to release and withdraw this line.

One or more other springs 11 can be used for the drive in place of the helical springs explained and illustrated. If the vessel cannot be kept with her bows in the wind, or whenever the wind pressure on the sail is too strong for the spring 11 to be effective for reefing purposes, as may happen when the reefing is left until too late, then the shafts 7 and 15 are interconnected by means of the bolt 10 or some equivalent coupling device. It is then possible for the force of the spring 11 to be assisted manually, by means of the worm shaft 9 or other drive, not shown, for the hollow shaft 7. It should be pointed out that the external drive of the shafts 7 or 8 is provided with a non-return stop which, in the example in question, is formed by the self-locking system of the worm gear 9, 19.

The reefing device can also be operated in an emergency, if the internal drive for the shaft 7 provided by the spring 11 happens to fail. In that case reefing can be effected externally via the gearing 9 and 19, after the shafts 7 and 8 have been coupled together.

For draining purposes the boom is provided, in the base, opposite to the side containing the slit 2, with a sufficient number of drainage holes 20 through which the water can be discharged. Furthermore, the head bearing 4 of the boom is so constructed that the entire boom can be fixed to the mast 5 or forestay 6 in either of two angular positions 180° apart. When the boat is not in use for an appreciable time, the boom is turned to bring the slit 2 lowermost, so that that part of the reefing apparatus which is situated within the boom is better protected against weather conditions. This is an additional safety device, although if all the bearings inside the boom are satisfactorily sealed and if the right materials are adopted it is possible to make reasonably certain that the functioning of the apparatus will not deteriorate as a result of corrosion.

While the provision of fittings required under normal operating conditions on a roller reefing gear of the conventional kind creates problems, those problems do not arise in the reefing apparatus described, because during sailing the boom always retains its preselected angular position about its axis. It is therefore possible, for instance, to provide hooks, rollers, cleats or other fittings on the exterior of the boom; those hooks can, in emergencies, be used in conjunction with the cringles 14 for reefing points.

What I claim as my invention and desire to secure by Letters Patent is:

1. Reefing apparatus for the sail of a sailing vessel having a sail with a footrope and comprising:
   (a) a hollow boom for the sail, said boom having a longitudinal slot therein with a length at least equal to that of the footrope of the sail;
   (b) a hollow shaft rotatably mounted within the boom and extending substantially the length of the slot, and to which said footrope is attachable; and
   (c) drive means for rotating the shaft in order to roll up the sail on the shaft,
   (d) said drive means comprising a helical spring disposed within and connected to said hollow shaft and stressed by unrolling of the sail, said spring subsequently effecting re-rolling of said sail on said shaft, and
   (e) manually operable means affording the capability of prestressing said spring prior to unrolling of said sail.

2. Reefing apparatus as set forth in claim 1 wherein the manually operable means for stressing said spring comprises a worm shaft and a worm wheel driven thereby, said spring being connected to said worm wheel.

3. Reefing apparatus as set forth in claim 1 and further including a releasable locking device acting between said shaft and said manually operable means.

4. Reefing apparatus as set forth in claim 3 wherein the locking device comprises a bolt disposed radially of said shaft and displaceable radially of said shaft.

5. Reefing apparatus as set forth in claim 4 and further including spring means biasing said bolt into locking position, said bolt being capable of manual retraction and holding in released position.

6. Reefing apparatus as set forth in claim 1 and further including means connecting the boom to a mast with said slot along the upper portion for use or with said slot along the lower portion thereof for storage.

* * * * *